United States Patent [19]

Hung

[11] Patent Number: 5,010,942

[45] Date of Patent: Apr. 30, 1991

[54] HOOKING FRAME OF A WINDOW/BATHROOM CURTAIN

[76] Inventor: Wu-Hu Hung, 8F., No. 126, Roosevelt Road, Sec 3, Taipei, Taiwan

[21] Appl. No.: 472,657

[22] Filed: Jan. 30, 1990

[51] Int. Cl.[5] ..... A47H 1/00

[52] U.S. Cl. ..... 160/349.1

[58] Field of Search ..... 160/349.1, 349.2, 330, 160/402; 248/316.7

[56] References Cited

U.S. PATENT DOCUMENTS

| | | | |
|---|---|---|---|
| 4,098,318 | 7/1978 | Ruegsegger | 160/349.2 X |
| 4,343,344 | 8/1982 | Shelton | 160/349.2 |
| 4,559,988 | 12/1985 | Nocerino | 160/349.2 |
| 4,594,741 | 6/1986 | Payne | 160/349.2 X |
| 4,887,324 | 12/1989 | Cairns | 160/349.2 X |

FOREIGN PATENT DOCUMENTS

| | | | |
|---|---|---|---|
| 997670 | 9/1976 | Canada | 160/349.1 |

*Primary Examiner*—David M. Purol

*Attorney, Agent, or Firm*—Bacon & Thomas

[57] ABSTRACT

This invention relates to a retaining bracket for a window/bathroom curtain which has a base body and a pushing member. The pushing member has projecting tabs located in each of its two lateral sides. By urging the pushing member against the base body, a clamping force will be produced to clamp a fixed edge of the curtain. The pushing member can also be moved downwardly and, by inserting the tabs into corresponding holes in the base body exert a clamping force in this position. In both upper and the lower positions the pushing member can exert a clamping force on the curtain. In addition, a hook, which is attached to a side of the base body, will retain the curtain in a folded position and will also prevent the window or bathroom curtain from being pulled excessively.

5 Claims, 3 Drawing Sheets

HOOKING FRAME OF A WINDOW/BATHROOM CURTAIN

BACKGROUND OF THE INVENTION

This invention relates to a retainer bracket for a window/bathroom curtain, particularly such a retainer having means to clamp and fix a curtain.

As we all know, a curtain is a piece of cloth or lace hung up at a window or door. Speaking in terms of the mode of application of a curtain, it may be classified into a horizontal and a vertical type. No matter whether it is a horizontal or a vertical type, its application theory lies in having a free end of the window curtain, and a fixed end. Movement of the free end will move the other parts to enable the curtain to be pulled apart until it reaches the position of the fixed end to uncover the window or door. The curtain may be deviated from the window or door in the course of its operation because the fixed end has not been fixed or not been firmly fixed. Moreover, even after it has been pulled across the window or door, people are usually lazy in fixing the free end, but just leave it hanging at one side of the window or door and, thus, leave the curtain in a semi-opened condition. Even when fixing of the free end is deemed necessary, people will have to take the trouble of fastening a rope or tie around the curtain to attach it to the positioning frame which is fixed at the wall. Since most of the people do not bother to take the trouble of fastening the rope or tie of a curtain, it is usually found to be loosely hung or excessively pulled, or will be easily blown off by wind.

SUMMARY OF THE INVENTION

The object of this invention is to provide a retainer bracket for a window/bathroom curtain which can clamp the fixed end of the curtain which will enable the curtain to be pulled across the window or door and prevent it from slipping out of the clamp and from entirely covering the window or door.

The present invention relates to a retaining bracket for a window/bathroom curtain comprising a base body and a pushing member in which the pushing member has tabs located at each of its two lateral sides. By urging the pushing member against a portion of the base body, a clamping force will be produced between a rubber cushion layer on the pushing member and a rubber cushion layer on the base body. Alternatively, the pushing member can be moved downwardly, and, by means of inserting the tabs into taper holes in the pushing member, can be fixed in this position. In both the upper and lower positions the pushing member can exert a clamping force. In addition, the hook, which is attached to a side of the base body, will not only allow the bracket to clamp the window or bathroom curtain, but will also prevent the window or bathroom curtain from being pulled excessively. It allows the window or bathroom curtain to open or close easily without allowing it semi-opened or semi-closed.

In order to provide a better understanding about the structure and features of the present invention, a preferred embodiment with related drawings is presented herein.

DETAILED DESCRIPTION OF THE PREFERRED EMBODIMENTS

Figure 1:
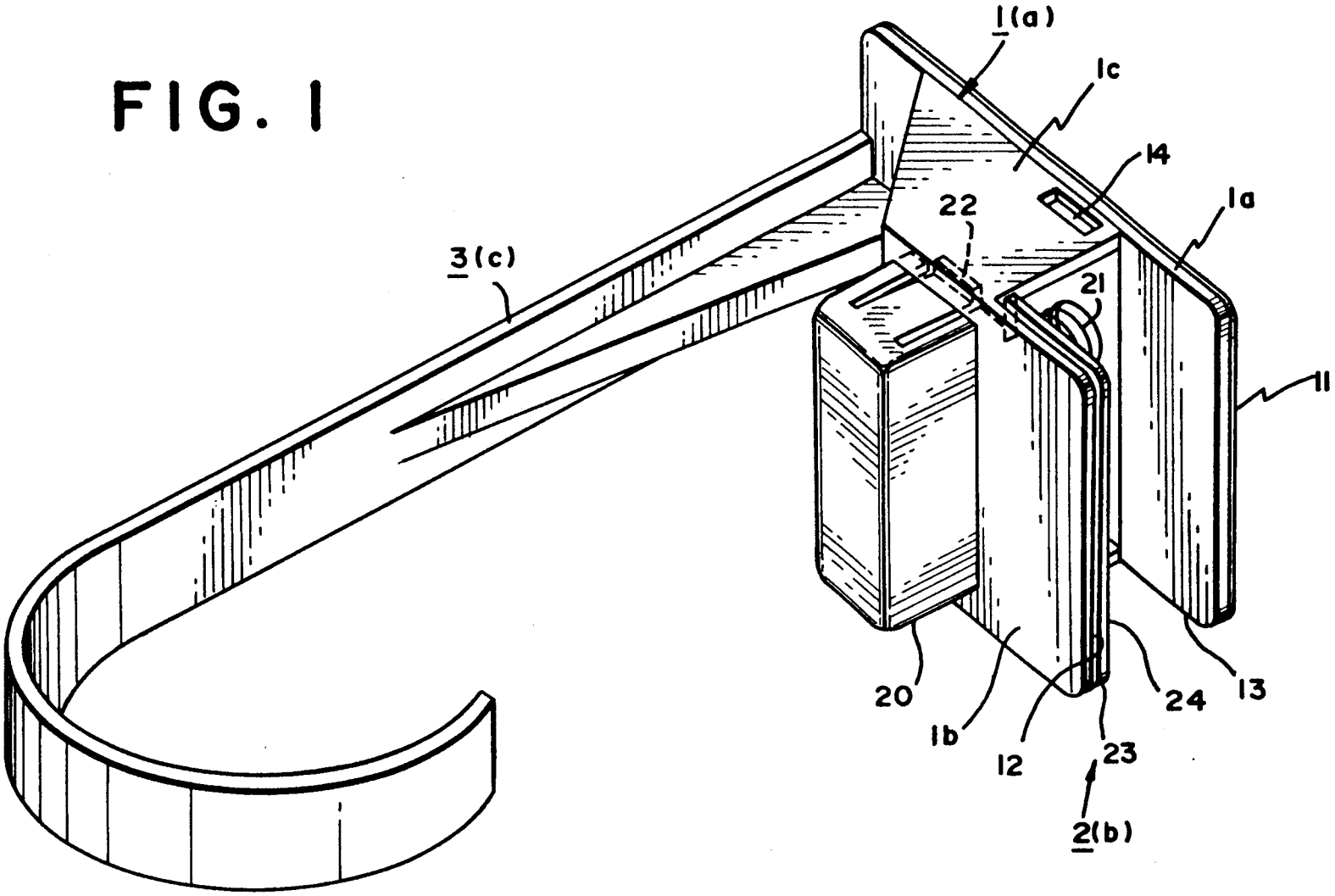
FIG. 1 is a perspective view of the retaining bracket according to the present invention.
Figure 4:
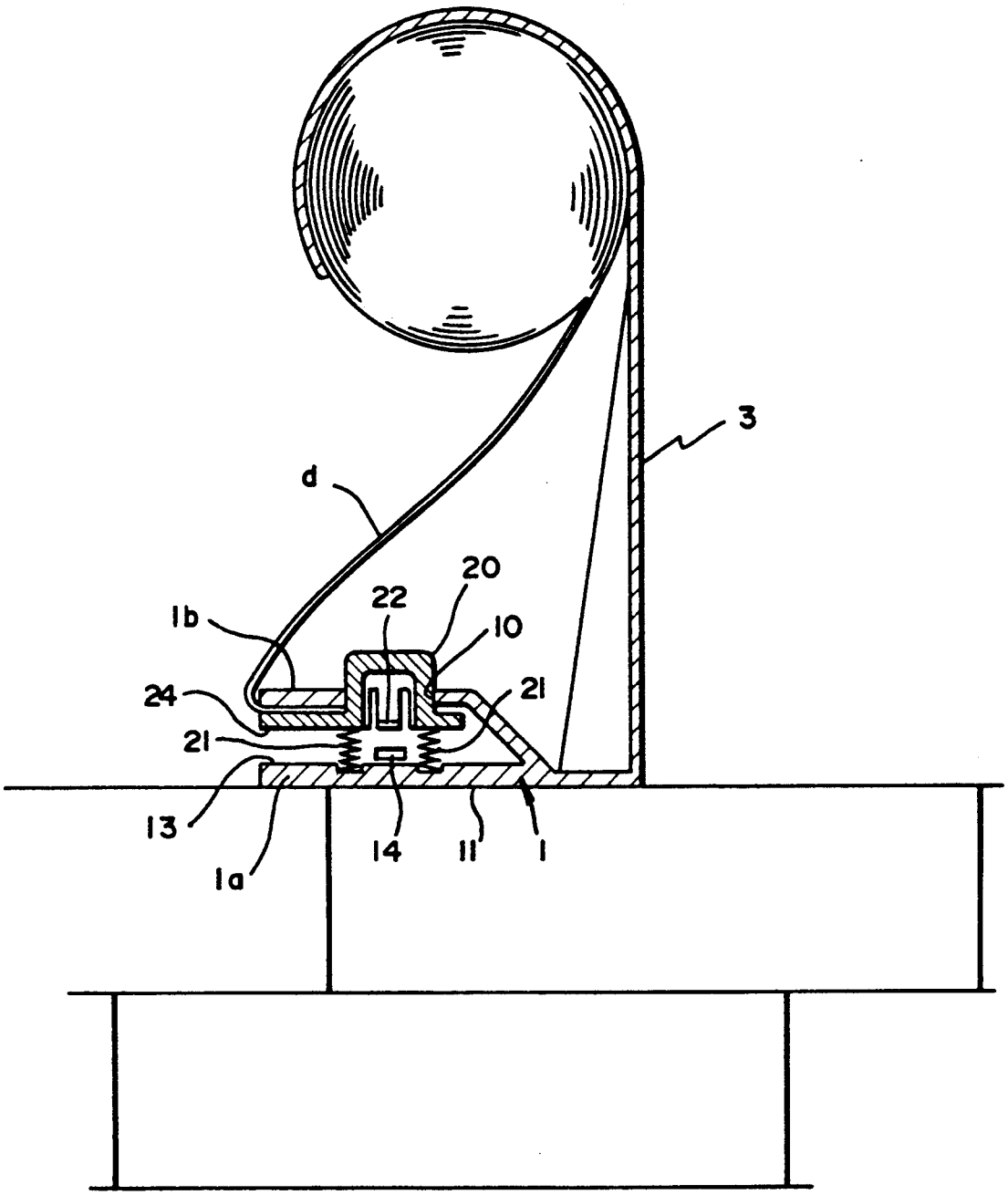
FIG. 4 is a top view of the retaining bracket according to the present invention.

As shown in FIG. 1, the present invention comprises an installation or fixing part (a), a window/bathroom curtain clamping part (b) and a window/bathroom collecting and fixing part (c). The fixing part (a) comprises a base body 1, having a hole 10 defined by one side of the base body 1 to accommodate a portion of pushing member 20. The base body I has a glued face 11 to fix the bracket onto the wall of a house. Layers of rubber cushion 12 and 13 are attached to the two interior facing surfaces of plate planes 1*a* and 1*b* of the base body 1. Lateral taper holes 14 are defined at each of two lateral sides 1*c* and 1*d* close to the edge of the bottom plate 1*a*. The window/bathroom clamping part (b) comprises a pushing member 20 a portion of which extends through the hole 10 of the base body 1. A plurality of compression springs 21 are located between the bottom of the pushing member 20 and the bottom plate 16 of the base body 1. At each of its two lateral sides the pushing member 20 defines tabs 22 which are located so as to engage the taper holes 14 of the base body 1. Rubber cushion layers 23 and 24 are located on opposite sides of the bottom plate of the pushing member 20. By means of the springing force of the compression springs 21, the layer of rubber cushion 23 on the pushing member 20 will be urged into contact with the rubber cushion layer 12 on the base body 1, so as to produce a clamping or gripping pressure between the two layers of rubber cushions 23 and 12 to serve as a means to fix an end of the curtain (d), as illustrated in FIG. 4. The curtain collecting and fixing part (c) comprises a hook 3 extending from the shaped base body i. Its largest width is equivalent to that of the base body.

Figure 2:
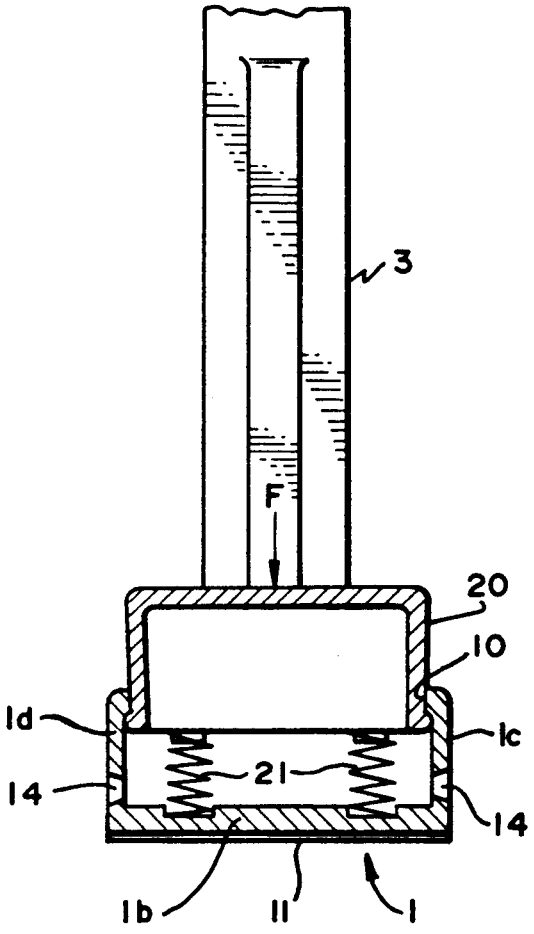
FIG. 2 is a partial cross-sectional view of the bracket shown in FIG. 1 with the pushing member in a first position.
Figure 3:
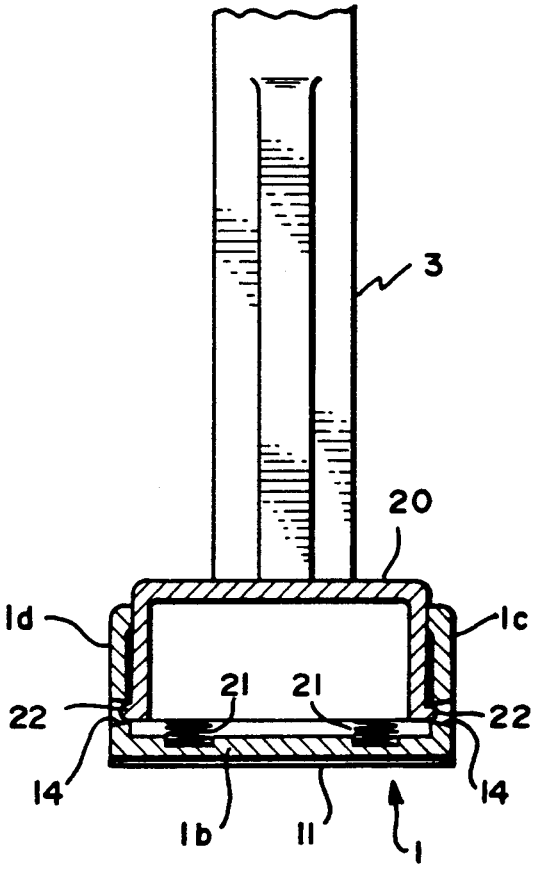
FIG. 3, is a view similar to FIG. 2 showing the pushing member in a second position.

FIGS. 2 and 3 are longitudinal sectional views of this invention, and illustrate how the tabs 22 are inserted into the taper holes 14. In the installation of this invention, it can be adhered to the wall of a house by means of directly applying the glued face 11 of the base body 1 to the wall. If desired, it may also be attached by nails. The fixing position is preferred to have clamping end plane and the window/bathroom curtain plane nearly together. In the operating process of this invention, the springing force of the compression springs 21 may clamp the fixed end of the window/bathroom curtain as illustrated in FIG. 4, on a downward movement of the pushing member 20 which inserts the tabs 22 into the taper holes 14 of the base body 1 may be used to provide a clamping force between the layer of the rubber cushion 24 at the bottom plate of pushing member 20 and the layer of the rubber cushion 13 on the base body 1, to clamp the fixed end of the curtain. After the fixed end of the curtain is clamped to the retaining bracket, the curtain may be pulled across the window and folded into the hook 3. The curtain may thus be easily folded and will remain folded so as not be scattered into a semi-opened condition. To use the tabs 22 of the pushing member 20 to release the fixed edge of the window curtain, a pushing motion is directly exerted onto tabs 22 of the pushing member 20 to enable the tabs 22 at both the left and right side to move inward until they move away from the taper holes 14. At this time, the pushing member 20 will, by means of the springing force of the compression springs 21, be elevated to move away from the layer of the rubber cushion 13 on the base body 1. The window or bathroom curtain will thus be released.

Summarizing the above-mentioned description, it can be seen that the structure which is being disclosed herein is indeed very effective. It not only provides a convenient means of fixing a curtain, but will also prevent the curtain from being excessively pulled across the window.

I claim:

1. A retaining bracket for a curtain comprising:

(a) a base body adapted to be attached to a wall or the like, the base body defining first and second spaced apart clamping surfaces.

(b) a pushing member having a clamping portion operatively associated with the base body so as to be reciprocally movable with respect to the base body between a first position wherein a clamping force is exerted between the clamping portion and the first clamping surface, and a second position wherein a clamping force is exerted between the clamping portion and the second clamping surface;

(c) biasing means operatively interposed between the pushing member and the base body to urge the pushing member toward its first position;

(d) releasable latching means operatively interposed between the pushing member and the base body to releasably latch the pushing member in its second position; and, (e) a hook member extending from the base body.

2. The retaining bracket of claim 1 further comprising an adhesive layer on at least a portion of the base body adapted to adhesively attach the base body to the wall or the like.

3. The retaining bracket of claim 1 further comprising a layer of rubber cushioning material on the first and second clamping surfaces, respectively.

4. The retaining bracket of claim 3 further comprising a layer of rubber cushioning material on the clamping portion of the pushing member.

5. The retaining bracket of claim 1 wherein the releasable latching means comprises:

(a) at least one opening defined by the base body; and, (b) at least one tab projecting from the pushing member and located such that, when the pushing member is in its second position, the at least one tab engages the at least one opening.

* * * * *